US008591311B2

(12) United States Patent
Englman et al.

(10) Patent No.: US 8,591,311 B2
(45) Date of Patent: Nov. 26, 2013

(54) GAMING SYSTEM WITH CHALLENGE FEATURE

(75) Inventors: Allon G. Englman, Chicago, IL (US); Jeremy M. Hornik, Chicago, IL (US); Larry J. Pacey, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 1514 days.

(21) Appl. No.: 11/504,866

(22) Filed: Aug. 16, 2006

(65) Prior Publication Data

US 2007/0060263 A1 Mar. 15, 2007

Related U.S. Application Data

(60) Provisional application No. 60/708,433, filed on Aug. 16, 2005.

(51) Int. Cl.
*A63F 9/24* (2006.01)

(52) U.S. Cl.
USPC ..... 463/20; 463/16; 463/25; 273/138.1

(58) Field of Classification Search
USPC ..... 463/20, 21, 16; 273/292
See application file for complete search history.

(56) References Cited

U.S. PATENT DOCUMENTS

| | | | | |
|---|---|---|---|---|
| 4,624,459 A | | 11/1986 | Kaufman | 273/143 R |
| 4,837,728 A | | 6/1989 | Barrie et al. | 364/412 |
| 4,861,041 A | | 8/1989 | Jones et al. | 273/292 |
| 4,948,134 A | | 8/1990 | Suttle et al. | 273/85 |
| 5,116,055 A | | 5/1992 | Tracy | 273/138 A |
| 5,249,800 A | | 10/1993 | Hilgendorf et al. | 273/138 A |
| 5,275,400 A | | 1/1994 | Weingardt et al. | 463/12 |
| 5,280,909 A | | 1/1994 | Tracy | 273/138 A |
| 5,342,047 A | * | 8/1994 | Heidel et al. | 463/29 |
| 5,344,144 A | * | 9/1994 | Canon | 463/27 |
| 5,377,973 A | | 1/1995 | Jones et al. | 273/85 C |
| 5,393,057 A | | 2/1995 | Marnell, II | 273/85 CP |
| 5,417,430 A | | 5/1995 | Breeding | 273/292 |
| 5,524,888 A | | 6/1996 | Heidel | 463/22 |

(Continued)

FOREIGN PATENT DOCUMENTS

| | | | |
|---|---|---|---|
| CA | 2 334 546 | 8/2001 | G07F 17/34 |
| DE | 195 15 983 A1 | 11/1996 | G07F 17/34 |

(Continued)

OTHER PUBLICATIONS

Article for "Easy Riches" by Sigma Game, Strictly Slots, 1 page (Aug. 2001).

(Continued)

*Primary Examiner* — David L Lewis
*Assistant Examiner* — Chase Leichliter
(74) *Attorney, Agent, or Firm* — Nixon Peabody LLP

(57) ABSTRACT

A gaming system for conducting a wagering game comprises a value input device for receiving a wager from a player, a display, and a controller coupled to the display and operable to cause the display to present a challenge feature in response to a triggering event. The challenge feature includes a series of possible challenges of different types and having different objectives for successful completion. The series of challenges includes an outcome for awarding a progressive jackpot. The progressive jackpot is preferably displayed in terms of credits instead of currency. The controller successively advances the player from challenge to challenge in the series of challenges until the objective of the currently played challenge is not met.

28 Claims, 11 Drawing Sheets

(56) References Cited

U.S. PATENT DOCUMENTS 5,544,892 A 8/1996 Breeding ..... 273/292
5,564,700 A 10/1996 Celona ..... 463/27
5,577,959 A 11/1996 Takemoto ..... 463/25
5,580,063 A 12/1996 Edwards ..... 273/378
5,580,309 A 12/1996 Piechowiak et al. ..... 463/16
5,611,730 A 3/1997 Weiss ..... 463/20
5,645,486 A * 7/1997 Nagao et al. ..... 463/27
5,647,592 A 7/1997 Gerow ..... 463/139
5,655,961 A 8/1997 Acres et al. ..... 463/27
5,766,076 A 6/1998 Pease et al. ..... 463/27
RE35,864 E 7/1998 Weingardt ..... 463/28
5,779,549 A 7/1998 Walker et al. ..... 463/42
5,816,918 A 10/1998 Kelly et al. ..... 463/16
5,820,459 A 10/1998 Acres et al. ..... 463/25
5,823,874 A 10/1998 Adams ..... 463/17
5,839,956 A 11/1998 Takemoto ..... 463/25
5,848,932 A 12/1998 Adams ..... 463/20
5,851,147 A 12/1998 Stupak ..... 463/13
5,855,515 A 1/1999 Pease et al. ..... 463/27
5,876,284 A 3/1999 Acres et al. ..... 463/25
5,885,158 A 3/1999 Torango et al. ..... 463/27
5,941,773 A 8/1999 Harlick ..... 463/26
5,944,606 A 8/1999 Gerow ..... 463/27
5,951,011 A 9/1999 Potter et al. ..... 273/292
5,993,316 A * 11/1999 Coyle et al. ..... 463/25
6,003,013 A 12/1999 Boushy et al. ..... 705/10
6,007,427 A 12/1999 Wiener et al. ..... 463/17
6,012,982 A 1/2000 Piechowiak et al. ..... 463/16
6,047,963 A 4/2000 Pierce et al. ..... 273/121 B
6,089,977 A 7/2000 Bennett ..... 463/20
6,089,980 A 7/2000 Gauselmann ..... 463/27
6,102,474 A 8/2000 Daley ..... 296/836
6,102,799 A 8/2000 Stupak ..... 463/27
6,110,043 A * 8/2000 Olsen ..... 463/27
6,139,013 A 10/2000 Pierce et al. ..... 273/121 B
6,142,872 A 11/2000 Walker et al. ..... 463/16
6,146,273 A 11/2000 Olsen ..... 463/27
6,155,925 A 12/2000 Giobbi et al. ..... 463/20
6,158,741 A 12/2000 Koelling ..... 273/292
6,159,097 A 12/2000 Gura ..... 463/20
6,164,652 A * 12/2000 Lauretta et al. ..... 273/292
6,168,523 B1 1/2001 Piechowiak et al. ..... 463/26
6,203,010 B1 3/2001 Jorasch et al. ..... 273/138.1
6,206,374 B1 3/2001 Jones ..... 273/292
6,206,782 B1 3/2001 Walker et al. ..... 463/25
6,210,275 B1 4/2001 Olsen ..... 463/16
6,210,277 B1 4/2001 Stefan ..... 463/27
6,217,448 B1 4/2001 Olsen ..... 463/25
6,220,593 B1 4/2001 Pierce et al. ..... 273/138.1
6,224,482 B1 5/2001 Bennett ..... 463/20
6,224,484 B1 5/2001 Okuda et al. ..... 463/27
6,231,445 B1 5/2001 Acres ..... 463/42
6,254,483 B1 7/2001 Acres ..... 463/26
6,290,600 B1 * 9/2001 Glasson ..... 463/20
6,312,332 B1 11/2001 Walker et al. ..... 463/23
6,312,334 B1 * 11/2001 Yoseloff ..... 463/25
6,315,660 B1 11/2001 DeMar et al. ..... 463/16
6,319,125 B1 11/2001 Acres ..... 463/25
6,319,127 B1 11/2001 Walker et al. ..... 463/26
6,328,649 B1 12/2001 Randall et al.
6,336,859 B2 1/2002 Jones et al. ..... 463/13
6,336,862 B1 1/2002 Byrne ..... 463/27
6,345,824 B1 2/2002 Selitzky ..... 273/292
6,358,149 B1 3/2002 Schneider et al. ..... 463/27
6,361,441 B1 3/2002 Walker et al. ..... 463/42
6,364,768 B1 4/2002 Acres et al. ..... 463/25
6,375,567 B1 4/2002 Acres ..... 463/25
6,375,568 B1 4/2002 Roffman et al. ..... 463/26
6,416,409 B1 7/2002 Jordan ..... 463/27
6,431,983 B2 8/2002 Acres ..... 463/25
6,435,968 B1 8/2002 Torango ..... 463/27
6,439,995 B1 8/2002 Hughs-Baird et al. ..... 463/20
6,482,089 B2 11/2002 DeMar et al. ..... 463/20
6,506,117 B2 1/2003 DeMar et al. ..... 463/20
6,508,707 B2 1/2003 DeMar et al. ..... 463/16
6,511,375 B1 1/2003 Kaminkow
6,517,433 B2 2/2003 Loose et al. ..... 463/20
6,520,855 B2 2/2003 DeMar et al. ..... 463/20
6,577,733 B1 6/2003 Charrin ..... 380/251
6,585,591 B1 7/2003 Baerlocher et al.
6,589,115 B2 7/2003 Walker et al. ..... 463/25
6,592,458 B1 7/2003 Ho ..... 463/17
6,592,460 B2 7/2003 Torango ..... 463/27
6,595,854 B2 7/2003 Hughs-Baird et al.
6,599,185 B1 7/2003 Kaminkow et al.
6,599,186 B1 7/2003 Walker et al. ..... 463/17
6,599,188 B2 7/2003 Hirsch et al. ..... 463/19
6,599,193 B2 7/2003 Baerlocher et al. ..... 463/27
6,601,771 B2 8/2003 Charrin ..... 235/492
6,605,003 B2 * 8/2003 Suchocki et al. ..... 463/29
6,612,927 B1 9/2003 Slomiany et al.
6,634,943 B1 * 10/2003 Baerlocher ..... 463/25
6,638,164 B2 10/2003 Randall et al.
6,648,762 B2 11/2003 Walker et al. ..... 463/25
6,656,052 B2 12/2003 Abramopoulos et al. ..... 463/47
6,676,513 B2 1/2004 Gauselmann ..... 463/20
6,688,977 B1 2/2004 Baerlocher et al.
6,712,695 B2 3/2004 Mothwurf et al. ..... 463/25
6,722,982 B2 4/2004 Kaminkow et al.
6,733,390 B2 5/2004 Walker et al. ..... 463/23
6,776,715 B2 8/2004 Price ..... 463/27
6,786,819 B2 * 9/2004 Baerlocher et al. ..... 463/20
6,796,899 B2 9/2004 Baerlocher
6,802,775 B2 10/2004 Baerlocher et al.
6,863,607 B2 3/2005 Gerrard
6,875,108 B1 4/2005 Hughs-Baird
6,887,154 B1 5/2005 Luciano, Jr. et al. ..... 463/26
6,913,533 B2 7/2005 Cuddy et al.
6,932,701 B2 8/2005 Glavich et al.
6,966,833 B2 11/2005 Kaminkow et al.
6,971,954 B2 12/2005 Randall et al.
6,986,710 B2 1/2006 Baerlocher et al.
7,004,466 B2 2/2006 Gauselmann ..... 463/138
7,036,012 B2 4/2006 Charrin ..... 713/169
7,056,215 B1 6/2006 Olive ..... 463/27
7,104,886 B2 9/2006 Baerlocher et al.
7,131,908 B2 * 11/2006 Baerlocher ..... 463/20
7,160,186 B2 1/2007 Cuddy et al.
7,160,188 B2 1/2007 Kaminkow et al.
7,182,689 B2 2/2007 Hughs-Baird et al.
7,192,349 B2 3/2007 Baerlocher et al.
7,235,011 B2 6/2007 Randall et al.
7,273,415 B2 9/2007 Cregan et al.
7,278,919 B2 * 10/2007 Souza et al. ..... 463/25
7,303,469 B2 12/2007 Kaminkow
7,318,773 B2 1/2008 Baerlocher
7,338,367 B2 3/2008 Kaminkow et al.
7,341,512 B2 3/2008 Dolloff et al.
7,357,712 B2 4/2008 Mead et al.
7,481,430 B1 * 1/2009 Jackson et al. ..... 273/138.1
2002/0138594 A1 9/2002 Rowe ..... 709/219
2002/0151345 A1 10/2002 Byrne ..... 463/18
2002/0155874 A1 10/2002 Byrne ..... 463/16
2003/0014370 A1 1/2003 Charrin ..... 705/65
2003/0027618 A1 2/2003 Byrne ..... 463/16
2003/0036430 A1 2/2003 Cannon ..... 463/42
2003/0045337 A1 3/2003 Byrne ..... 463/16
2003/0050106 A1 3/2003 Lyfoung ..... 463/13
2003/0060266 A1 3/2003 Baerlocher ..... 463/20
2003/0064776 A1 4/2003 Byrne ..... 463/16
2003/0109306 A1 6/2003 Karmarkar ..... 463/40
2003/0148808 A1 8/2003 Price ..... 463/27
2003/0181231 A1 9/2003 Vancura et al. ..... 463/9
2003/0186733 A1 10/2003 Wolf et al. ..... 463/16
2003/0211884 A1 11/2003 Gauselmann ..... 463/20
2003/0216166 A1 11/2003 Baerlocher et al. ..... 463/20
2003/0222402 A1 12/2003 Olive ..... 273/292
2003/0228899 A1 12/2003 Evans ..... 463/25
2003/0236116 A1 12/2003 Marks et al. ..... 463/16
2004/0009808 A1 * 1/2004 Gauselmann ..... 463/25
2004/0009811 A1 1/2004 Torango ..... 463/25
2004/0023716 A1 2/2004 Gauselmann ..... 463/23
2004/0038741 A1 2/2004 Gauselmann ..... 463/42
2004/0048644 A1 3/2004 Gerrard et al. ..... 463/16

(56) References Cited

U.S. PATENT DOCUMENTS

| | | | | |
|---|---|---|---|---|
| 2004/0092304 | A1 | 5/2004 | George | 463/29 |
| 2004/0106448 | A1 | 6/2004 | Gauselmann | |
| 2004/0147306 | A1* | 7/2004 | Randall et al. | 463/20 |
| 2004/0198487 | A1* | 10/2004 | Schneider | 463/20 |
| 2005/0003880 | A1 | 1/2005 | Engleman | 463/16 |
| 2005/0055113 | A1* | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0064930 | A1 | 3/2005 | Jubinville et al. | 463/17 |
| 2005/0096130 | A1 | 5/2005 | Mullins | 463/27 |
| 2005/0137010 | A1 | 6/2005 | Enzminger et al. | 463/25 |
| 2005/0192088 | A1 | 9/2005 | Hartman et al. | 463/27 |
| 2005/0215313 | A1 | 9/2005 | O'Halloran | 463/26 |
| 2006/0003829 | A1 | 1/2006 | Thomas | 463/20 |
| 2006/0019737 | A1 | 1/2006 | Yang | 463/19 |
| 2006/0025195 | A1 | 2/2006 | Pennington et al. | 463/16 |
| 2006/0025200 | A1* | 2/2006 | Van Asdale | 463/20 |
| 2006/0025210 | A1 | 2/2006 | Johnson | 463/25 |
| 2006/0030391 | A1* | 2/2006 | Casey et al. | 463/16 |
| 2006/0030403 | A1 | 2/2006 | Lafky et al. | 463/27 |
| 2006/0052159 | A1 | 3/2006 | Cahill et al. | 463/27 |
| 2006/0073877 | A1 | 4/2006 | Rodgers et al. | 463/20 |
| 2006/0073889 | A1 | 4/2006 | Edidin et al. | 463/27 |
| 2006/0116201 | A1 | 6/2006 | Gauselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0160624 | A1* | 7/2006 | Slomiany et al. | 463/42 |
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0281527 | A1 | 12/2006 | Dunaevsky et al. | 463/20 |
| 2006/0287077 | A1* | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |

FOREIGN PATENT DOCUMENTS

| | | | | |
|---|---|---|---|---|
| DE | 196 24 321 | A1 | 1/1998 | G07F 17/32 |
| EP | 0 521 599 | A1 | 1/1993 | G07F 17/34 |
| GB | 2 153 572 | A | 8/1985 | G07F 17/34 |
| GB | 2 181 589 | A | 4/1987 | G07F 17/34 |
| GB | 2 242 300 | A | 9/1991 | G07F 17/34 |
| GB | 2 313 792 | A | 10/1997 | A63F 5/00 |
| GB | 2 333 880 | A | 8/1999 | G07F 17/34 |
| WO | WO 99 03078 | A1 | 1/1999 | G07F 17/34 |
| WO | WO 99/19037 | A1 | 4/1999 | A63F 9/22 |
| WO | WO 01/33478 | A1 | 5/2001 | G06F 19/00 |
| WO | WO 03/026754 | A1 | 4/2003 | A63F 5/00 |
| WO | WO 03/083789 | A1 | 10/2003 | |

OTHER PUBLICATIONS

Article for "Millioniser" by Glenn Haussman, Strictly Slots, pp. 50-53 (Mar. 2004).

Product Sheet for "Big Games Safari," Igt, 24 pp. (2000).

"New '97 Games," International Gaming & Wagering Business, 24 pp. (Mar. 1997).

* cited by examiner

GAMING SYSTEM WITH CHALLENGE FEATURE

CROSS REFERENCE TO RELATED APPLICATION

This application claims the benefit of U.S. Provisional Application No. 60/708,433, filed Aug. 16, 2005, entitled "Gaming System with Challenge Feature."

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems and methods for playing wagering games, and more particularly, to a gaming system having a progressive challenge feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with"progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system for conducting a wagering game comprises a value input device for receiving a wager from a player, a display, and a controller coupled to the display and operable to cause the display to present a challenge feature in response to a triggering event. The challenge feature includes a series of possible challenges of different types and having different objectives for successful completion. The series of challenges includes an outcome for awarding a progressive jackpot. The progressive jackpot is preferably displayed in terms of credits instead of currency. The controller successively advances the player from challenge to challenge in the series of challenges until the objective of the currently played challenge is not met.

Additional aspects of the invention will be apparent to those of ordinary skill in the art in view of the detailed description of various embodiments, which is made with reference to the drawings, a brief description of which is provided below.

DETAILED DESCRIPTION

Figure 1:
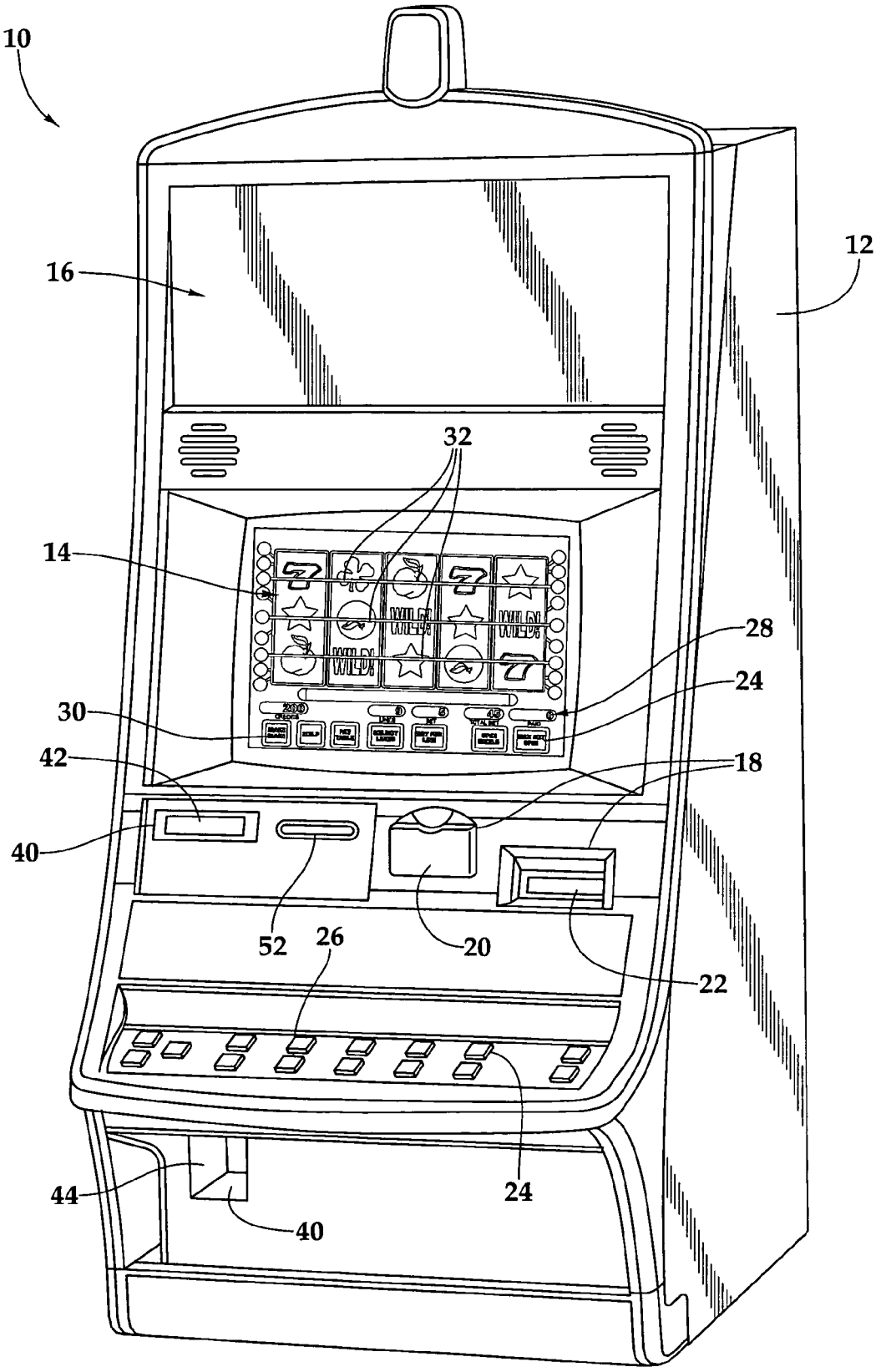
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
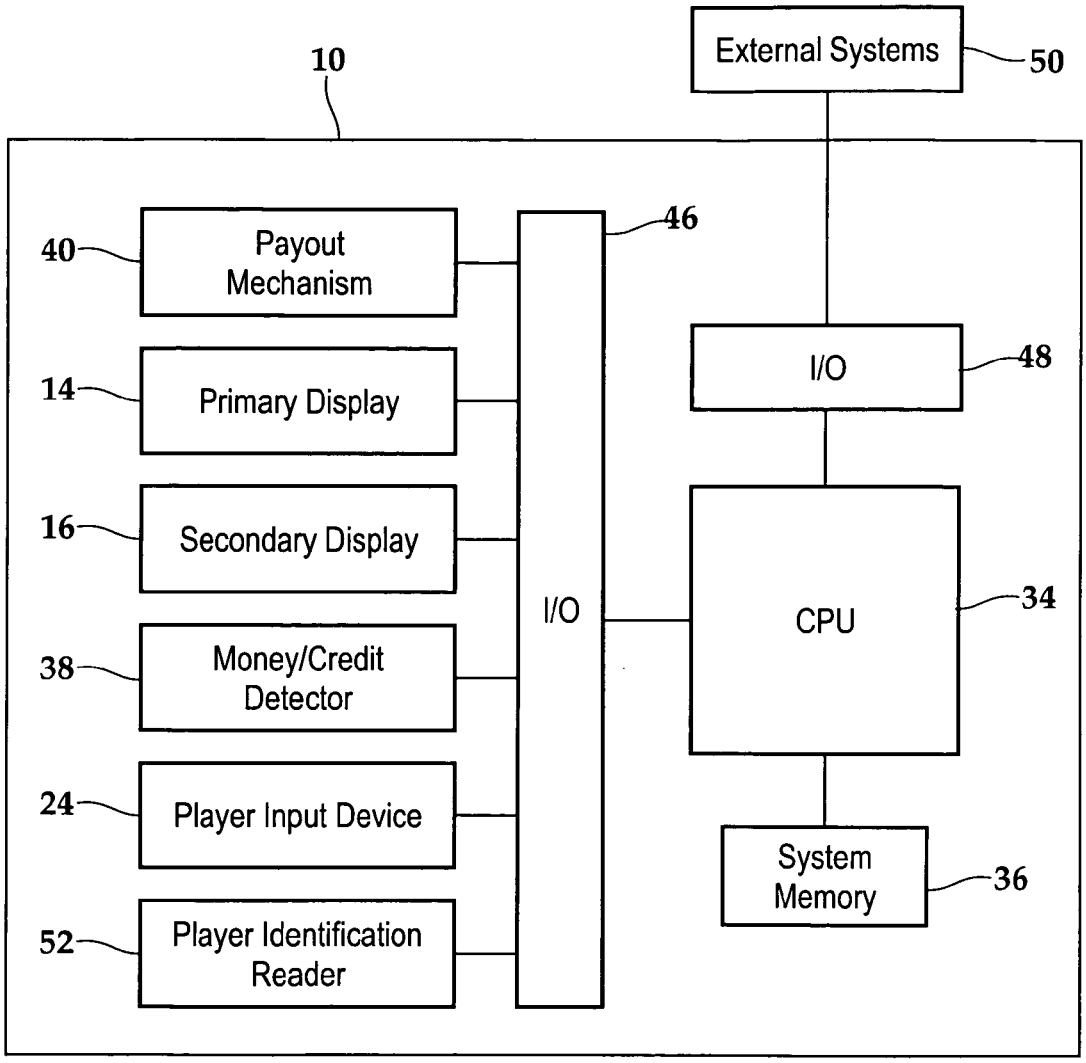
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the, value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
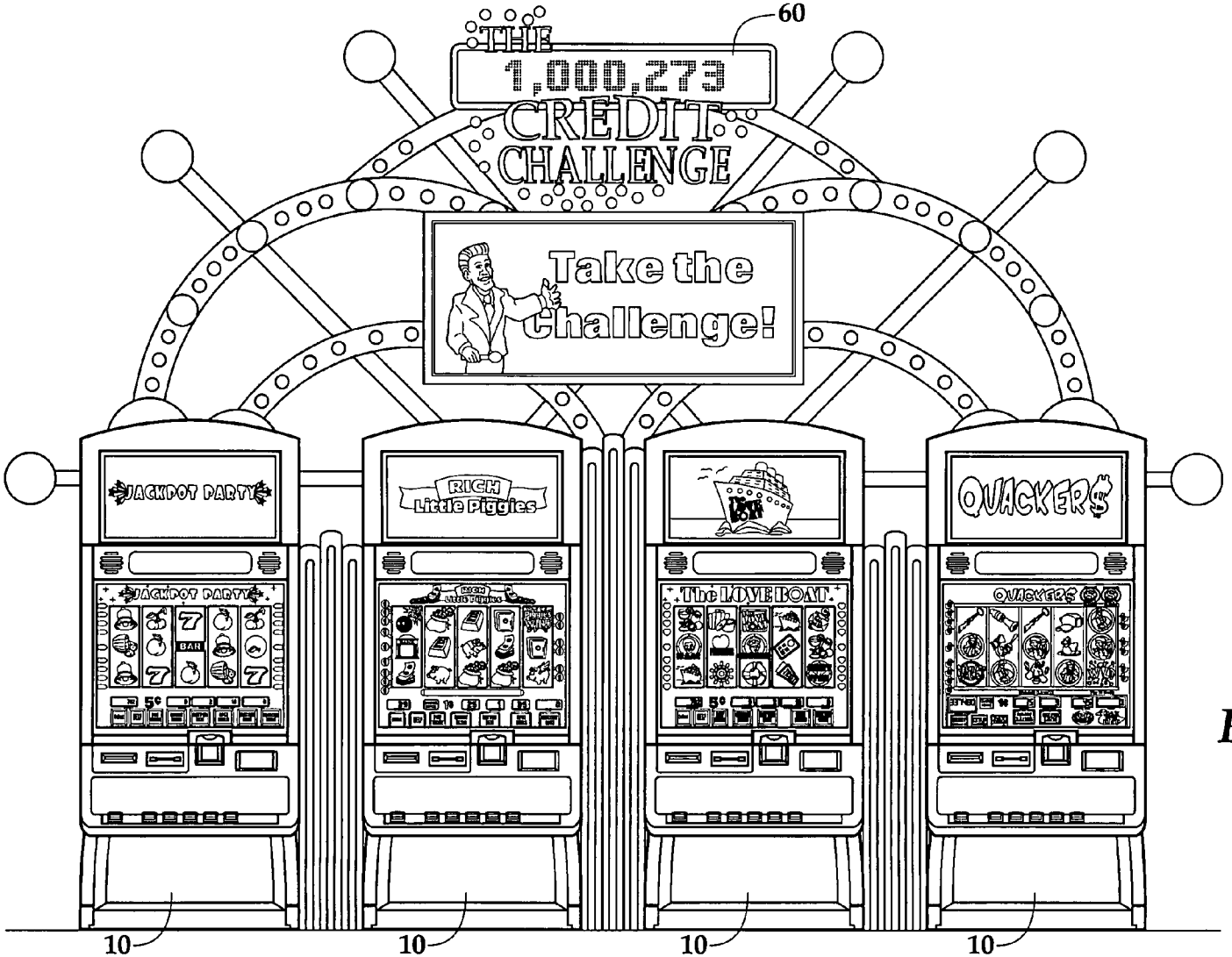
FIG. 3 is a front view of a bank of gaming machines embodying the present invention.

Referring to FIG. 3, the gaming machine 10 may be part of a group of networked gaming machines that contribute to a progressive jackpot 60 associated with a Million Credit Challenge bonus. The jackpot 60 increments in value based on predetermined or random criteria; for example, the jackpot 60 may increase based on the credits wagered or specific outcomes at the contributing machines. The jackpot 60 preferably is uniquely displayed in terms of game credits, instead of currency such as dollars and cents, and resets to a base value of one million credits in response to an award of the jackpot 60. Alternatively, the jackpot 60 may be conventionally displayed in terms of currency. The jackpot 60 may be displayed on the video display or jackpot meter at each of the networked gaming machines and/or on a community display or meter above the group of networked gaming machines. The number of linked machines may be less or greater than the number illustrated, and may be in the same bank, in multiple banks, in the same casino, or in multiple casinos. Also, the machines may be of the same or different themes and of the same or different denominations. In the illustrated example, the gaming machines are of different themes and of the same denomination, e.g. 25 cents.

The Million Credit Challenge bonus is a bonus feature that may be added to any underlying wagering game. To become eligible for the Million Credit Challenge bonus, a player must play all paylines and make an extra bet on his/her gaming machine. The extra bet may, for example, be 10 credits, of which 1 credit is contributed to the progressive jackpot 60. The Million Credit Challenge bonus may be triggered randomly without regard to the outcome of the underlying wagering game, or by a special outcome in the underlying wagering game.

Figure 4:
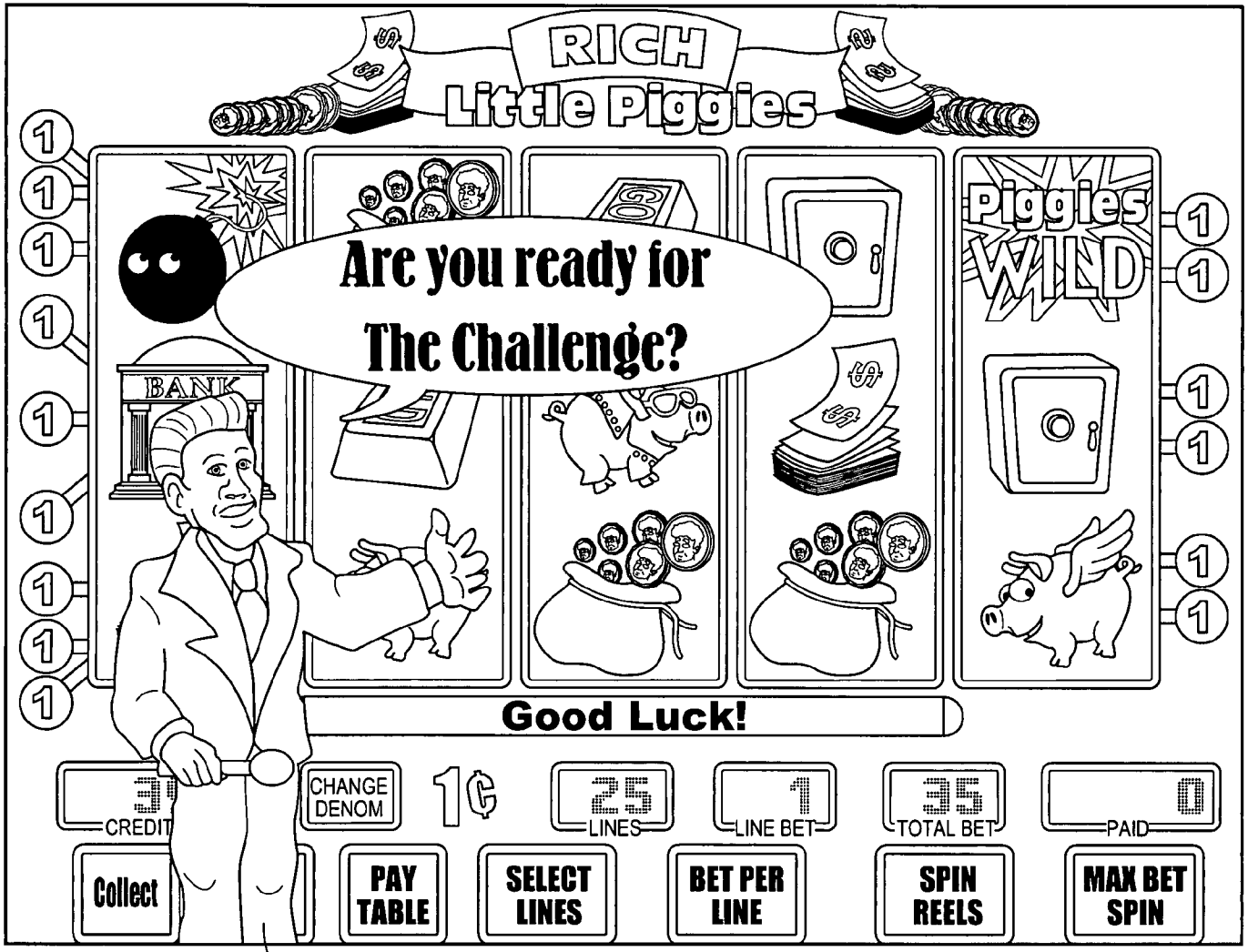
FIG. 4 is a display image associated with one of the gaming machines showing the Million Credit Challenge bonus in the process of being triggered.

Referring to FIG. 4, after the Million Credit Challenge bonus is triggered on one of the gaming machines, a host 62 interrupts the underlying wagering game and, in the case of an underlying video slot game, appears in front of the reels of the slot game. The host 62 brings the player to a Challenge screen in FIG. 5. The Million Credit Challenge bonus may be executed by a controller located inside and/or outside the gaming machine on which the Million Credit Challenge bonus is triggered. In addition to being displayed on the video display of the gaming machine on which the Million Credit Challenge bonus is triggered, the Million Credit Challenge bonus may be duplicated on a community video display located above the group of networked gaming machines.

Figure 5:
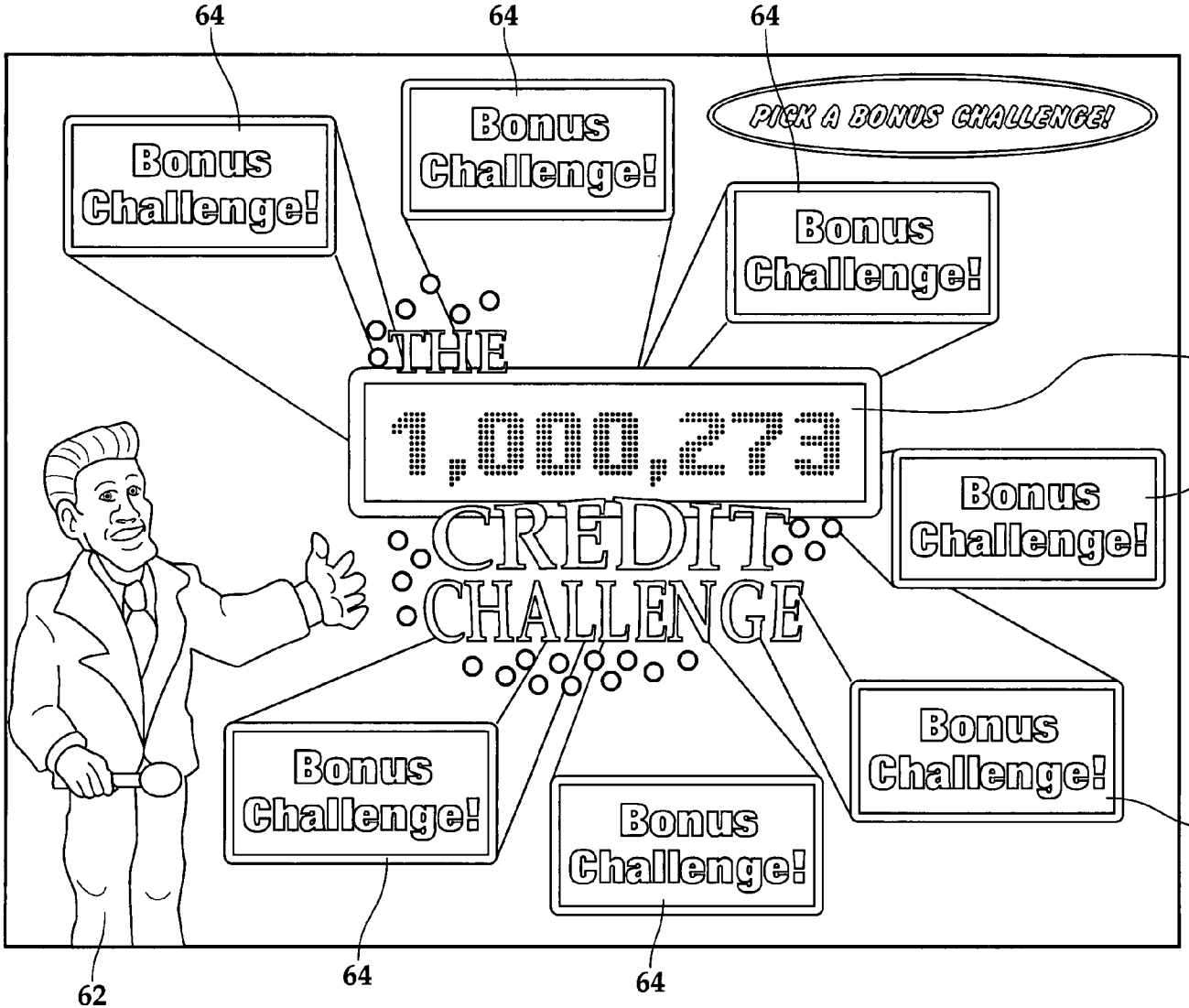
FIGS. 5 through 11 are display images associated with the Million Credit Challenge bonus.

Referring to FIG. 5, the player wins the top award, the progressive jackpot 60, by successfully completing every challenge. In the illustrated example, there are seven challenges having different game play mechanics and/or different objectives or thresholds for successful completion. The challenges may be interactive (e.g. picking games) or non-interactive (e.g. free spins of reels). In an interactive game, the objective or threshold for successful completion may involve finding a certain symbol prior to the game's termination, finding a certain number of symbols prior to the game's termination, accumulating at least a certain number of credits prior to the game's termination, accumulating less than a certain number of credits prior to the game's termination, etc. In a non-interactive game such as free spins of reels, the objective or threshold for successful completion may involve accumulating at least a certain number of credits during the free spins, accumulating less than a certain number of credits during the free spins, accumulating at least a certain number of a specific symbol during the free spins, accumulating on each reel at least a certain number of a specific symbol during the free spins, etc. Various challenges are described below.

To start the bonus, the player selects one of seven challenge icons 64. After each successfully completed challenge, the player returns to the Challenge screen in FIG. 5 to select another challenge icon 64 that was not selected previously. The challenge icons 64 are preferably associated with respective challenges prior to any selections being made by the player, and the challenge associated with an icon 64 is preferably revealed in response to selection of that icon. Alternatively, the challenge icons 64 may include indicia indicating the challenges associated therewith such that the player can decide what challenges to play in what order. In another embodiment, the sequence of challenges to be played is scripted such that the player's selection has no effect on which challenge is played. The script may present the challenges in a predefined or random order.

Figure 6:
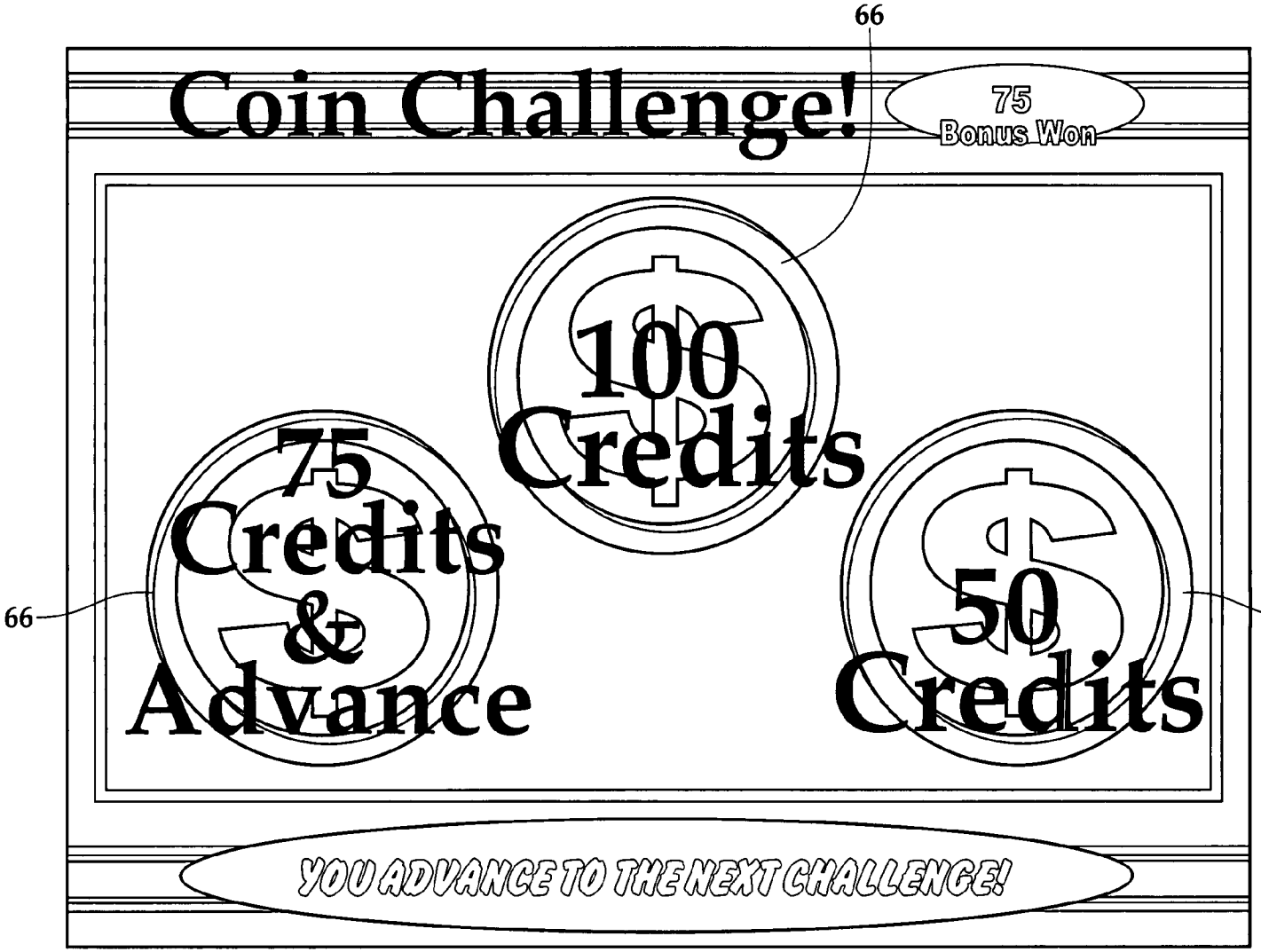

Referring to FIG. 6, the player's first selection results in the Coin Challenge. In the Coin Challenge, the player selects one of three coins 66 to reveal a credit award. If the word,"Advance," is also revealed with the credit award, the player successfully completes the Coin Challenge and returns to the Challenge screen in FIG. 5 to select another challenge icon 64 and thereby advance to another challenge. Otherwise, the Million Credit Challenge ends (with the player keeping any credit awards from the played challenge) and returns the player to the underlying wagering game. In the illustrated example, the player successfully completes the Coin Challenge in FIG. 6 and then, after selecting another challenge icon 64 in FIG. 5, proceeds to the Winner Challenge.

Figure 7:
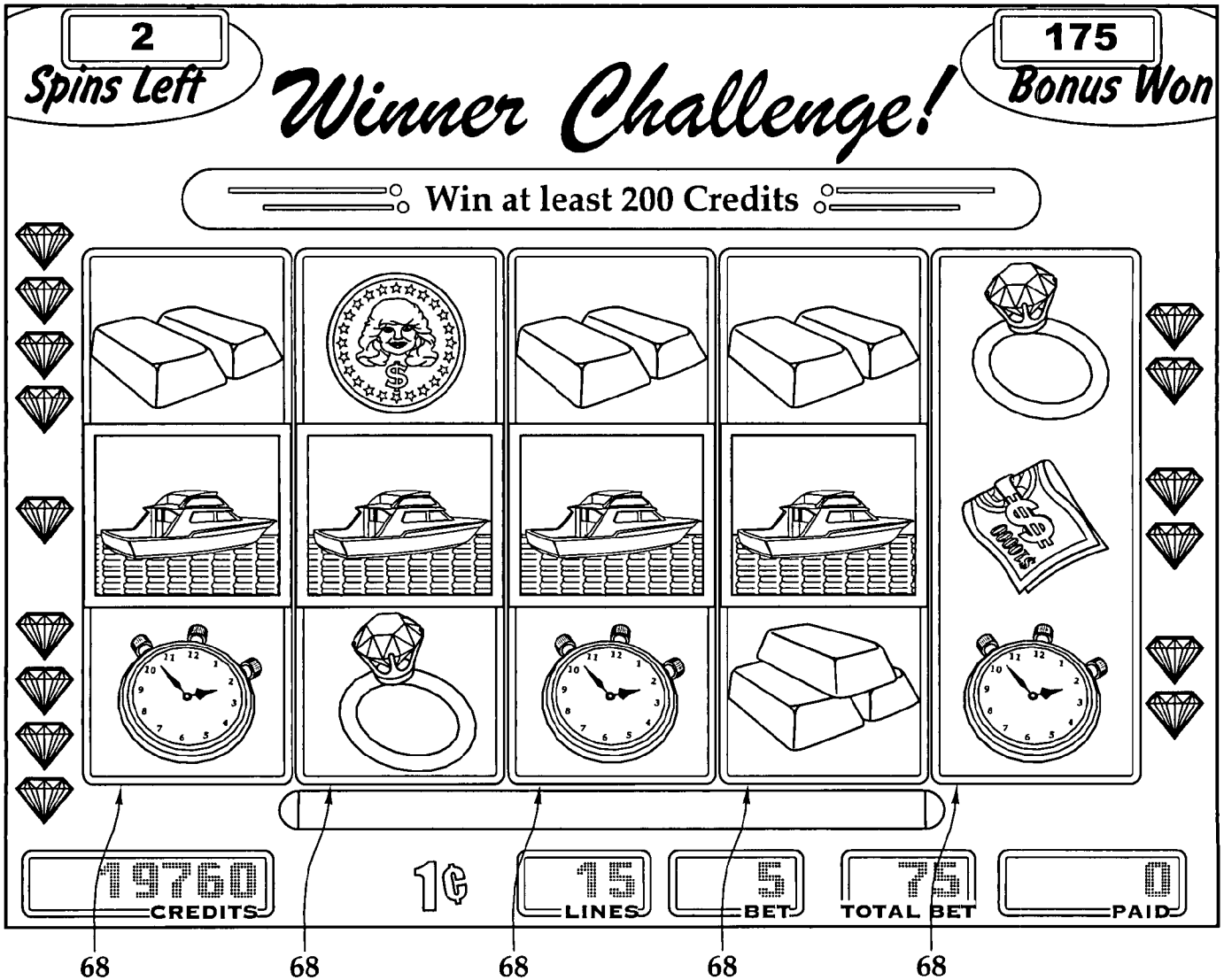

Referring to FIG. 7, in the Winner Challenge, the player is given ten free spins of the bonus reels 68 to earn at least 200 credits. The player is awarded credits for any predefined winning combinations (e.g., line pays and scatter pays) that appear on the reels 68 during the free spins. The bonus reels 68 and symbols thereon may be the same or different from the reels of the underlying wagering game played on the gaming machine. If the player earns at least 200 credits from these free spins, the player successfully completes the Winner Challenge and returns to the Challenge screen in FIG. 5 to select another challenge icon 64 and thereby advance to another challenge. Otherwise, the Million Credit Challenge ends (with the player keeping any credit awards from the previously played challenges) and returns the player to the underlying wagering game. In the illustrated example, the player successfully completes the Winner Challenge in FIG. 7 and then, after selecting another challenge icon 64 in FIG. 5, proceeds to the Present Challenge.

Figure 8:
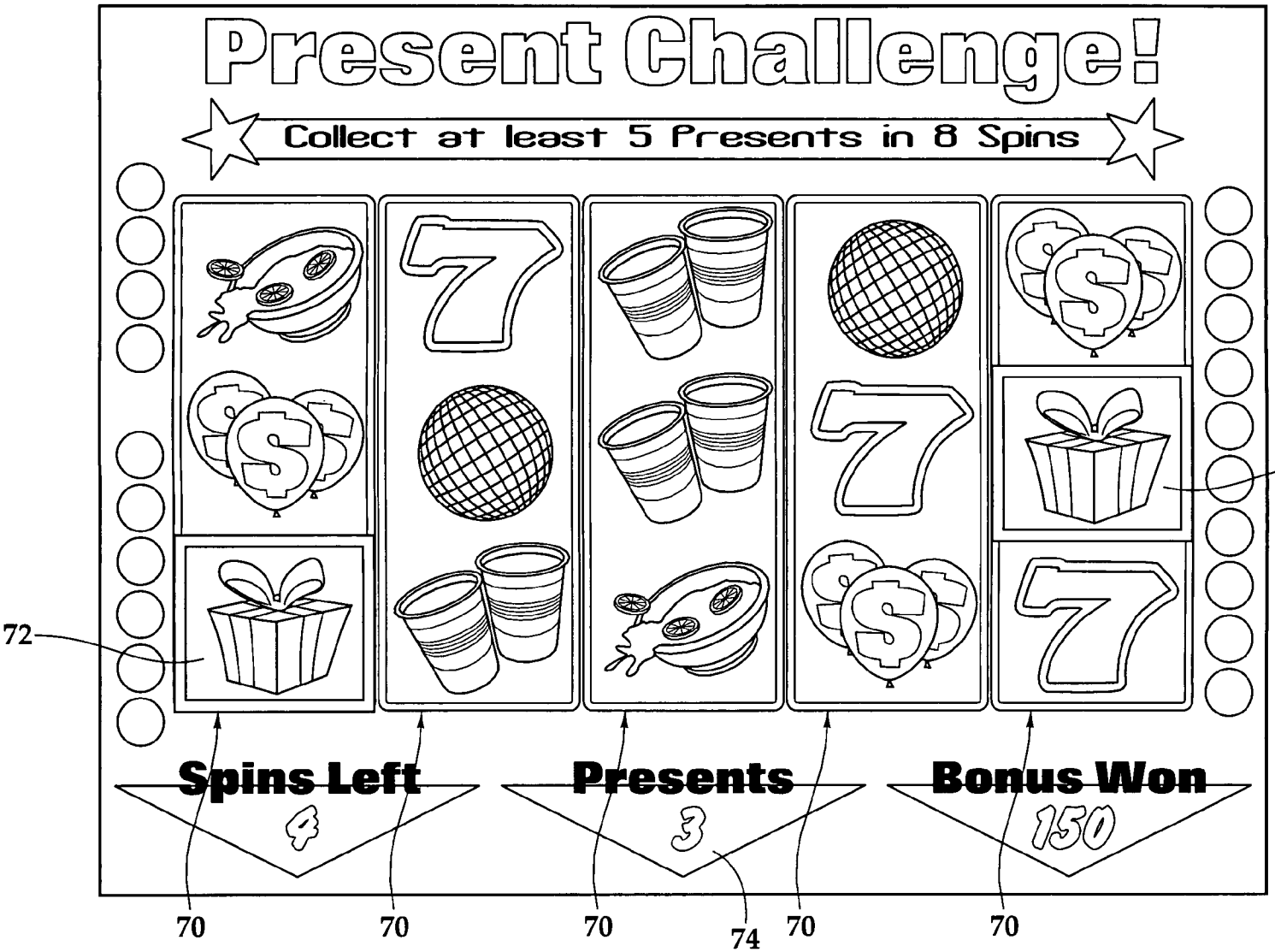

Referring to FIG. 8, in the Present Challenge, the player is given eight free spins of the bonus reels 70 to accumulate at least five Present symbols 72. A meter 74 tracks the number of Present symbols 72 that appear on the reels 70 over the course of the eight free spins. The player is also awarded credits for any predefined winning combinations (e.g., line pays and scatter pays) that appear on the reels 70 during the free spins. The bonus reels 70 and symbols thereon may be the same or different from the reels of the underlying wagering game played on the gaming machine. Also, the bonus reels 70 and symbols thereon may be the same or different from the bonus reels 68 used in the Winner Challenge. If a total of at least five Present symbols 72 appear on the reels 70 over the course of the eight free spins, the player successfully completes the Present Challenge and returns to the Challenge screen in FIG. 5 to select another challenge icon 64 and thereby advance to another challenge. Otherwise, the Million Credit Challenge ends (with the player keeping any credit awards from the previously played challenges) and returns the player to the underlying wagering game. In the illustrated example, the player successfully completes the Present Challenge in FIG. 8 and then, after selecting another challenge icon 64 in FIG. 5, proceeds to the Moneybag Challenge.

Figure 9:
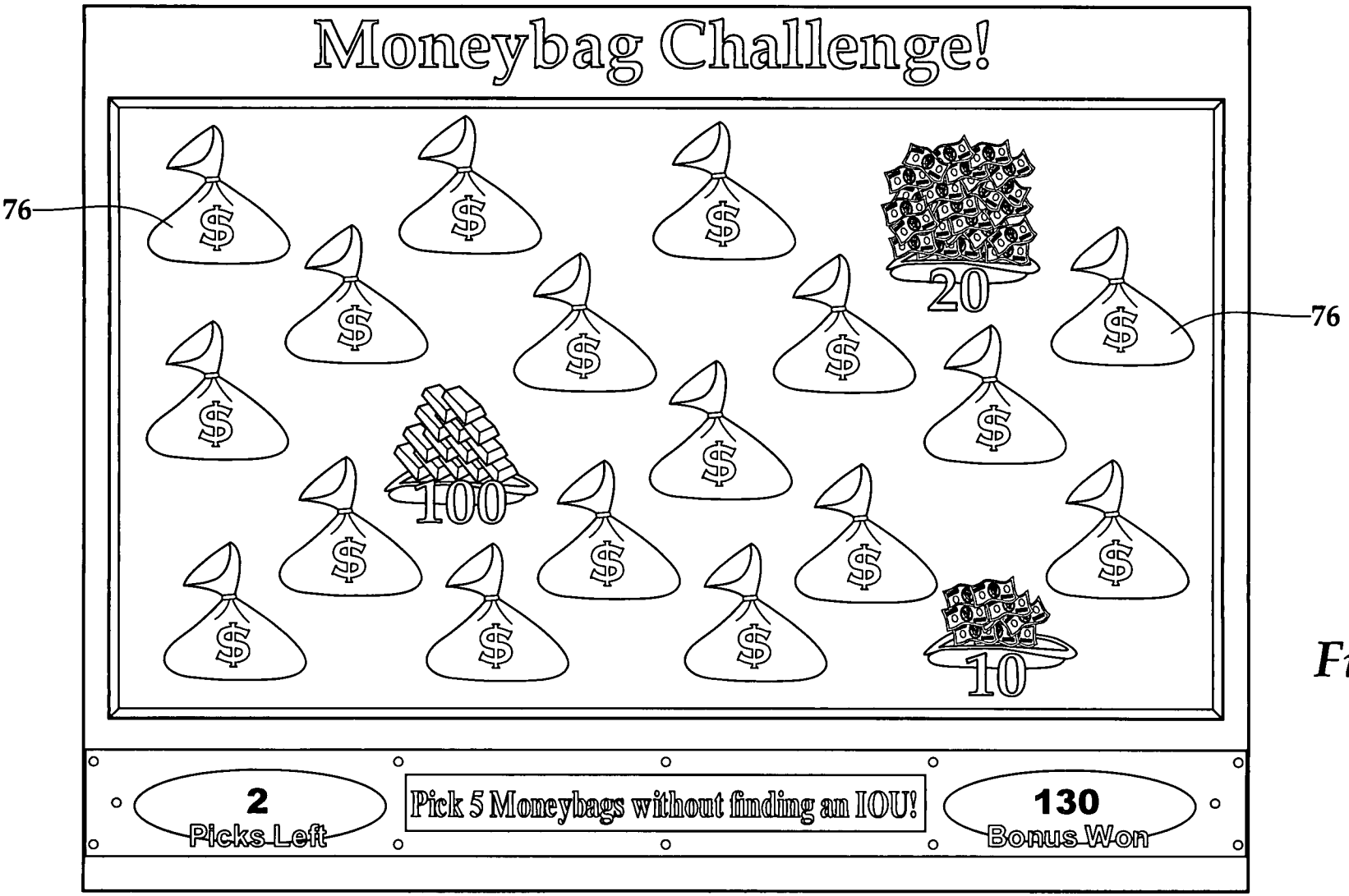

Referring to FIG. 9, in the Moneybag Challenge, the player selects five moneybags 76 from an array of moneybags 76. The moneybags 76 are preferably associated with respective awards (e.g. credit amounts) and/or IOU's prior to any selections being made by the player, and the award/IOU associated with a moneybag 76 is preferably revealed in response to selection of that moneybag 76. If the player selects at least five moneybags 76 without revealing an IOU, the player successfully completes the Moneybag Challenge and returns to the Challenge screen in FIG. 5 to select another challenge icon 64 and thereby advance to yet another challenge. Otherwise, the Million Credit Challenge ends (with the player keeping any credit awards from the previously played challenges) and returns the player to the underlying wagering game. In the illustrated example, the player successfully completes the Moneybag Challenge in FIG. 9 and then, after selecting another challenge icon 64 in FIG. 5, proceeds to the Slot Pay Challenge.

Figure 10:
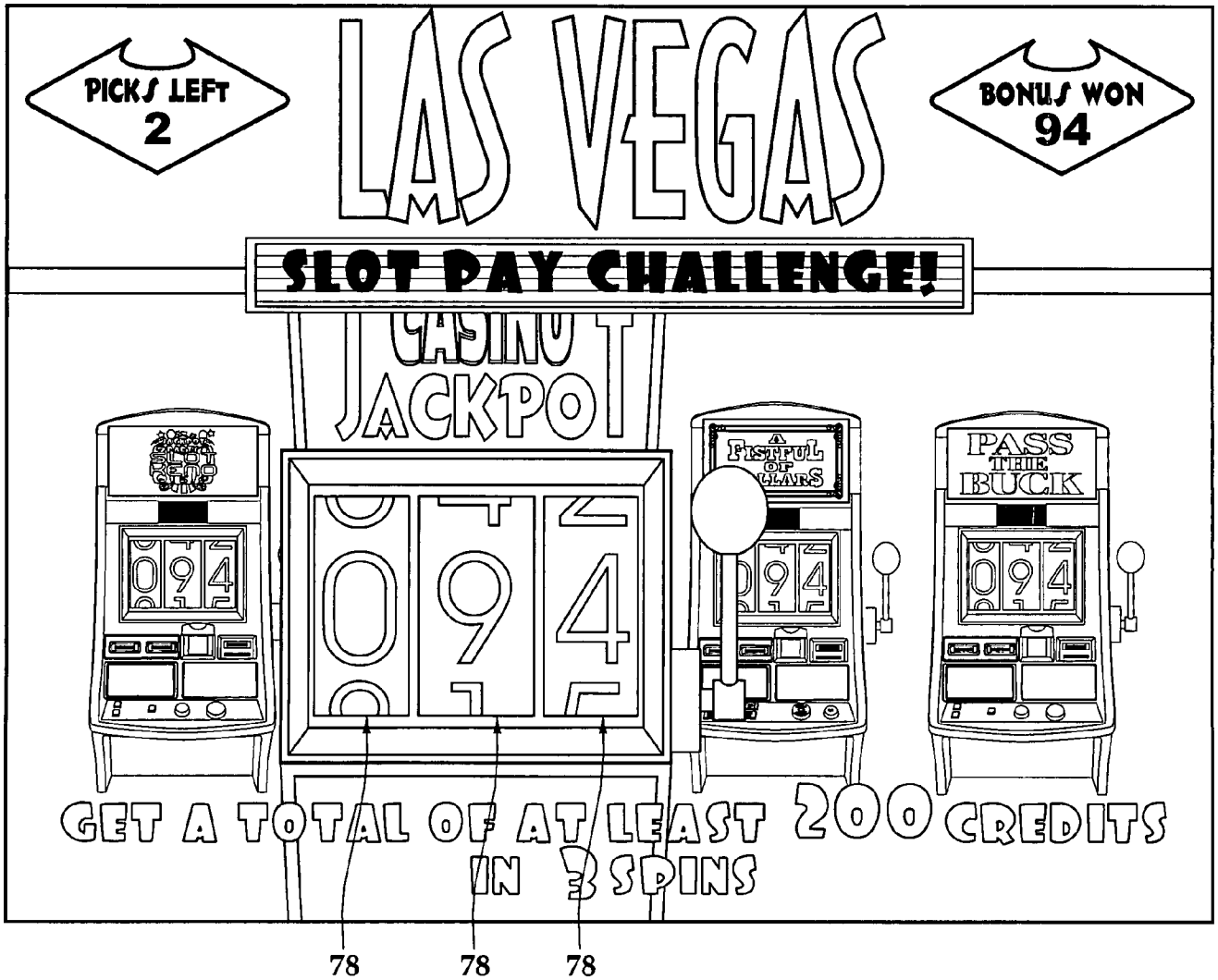

Referring to FIG. 10, in the Slot Play Challenge, the player is awarded three free spins of bonus reels 78 having digits thereon. For each free spin, the player is awarded a credit amount corresponding to the number formed by the digits on the reels. If the sum of the credit amounts from the three free spins exceeds 200 credits, the player successfully completes the Slot Play Challenge and returns to the Challenge screen in FIG. 5 to select another challenge icon 64 and thereby advance to yet another challenge. Otherwise, the Million Credit Challenge ends (with the player keeping any credit awards from the previously played challenges) and returns the player to the underlying wagering game. In the illustrated example, the player successfully completes the Slot Play Challenge in FIG. 10 and then, after selecting another challenge icon 64 in FIG. 5, proceeds to another challenge.

Figure 11:
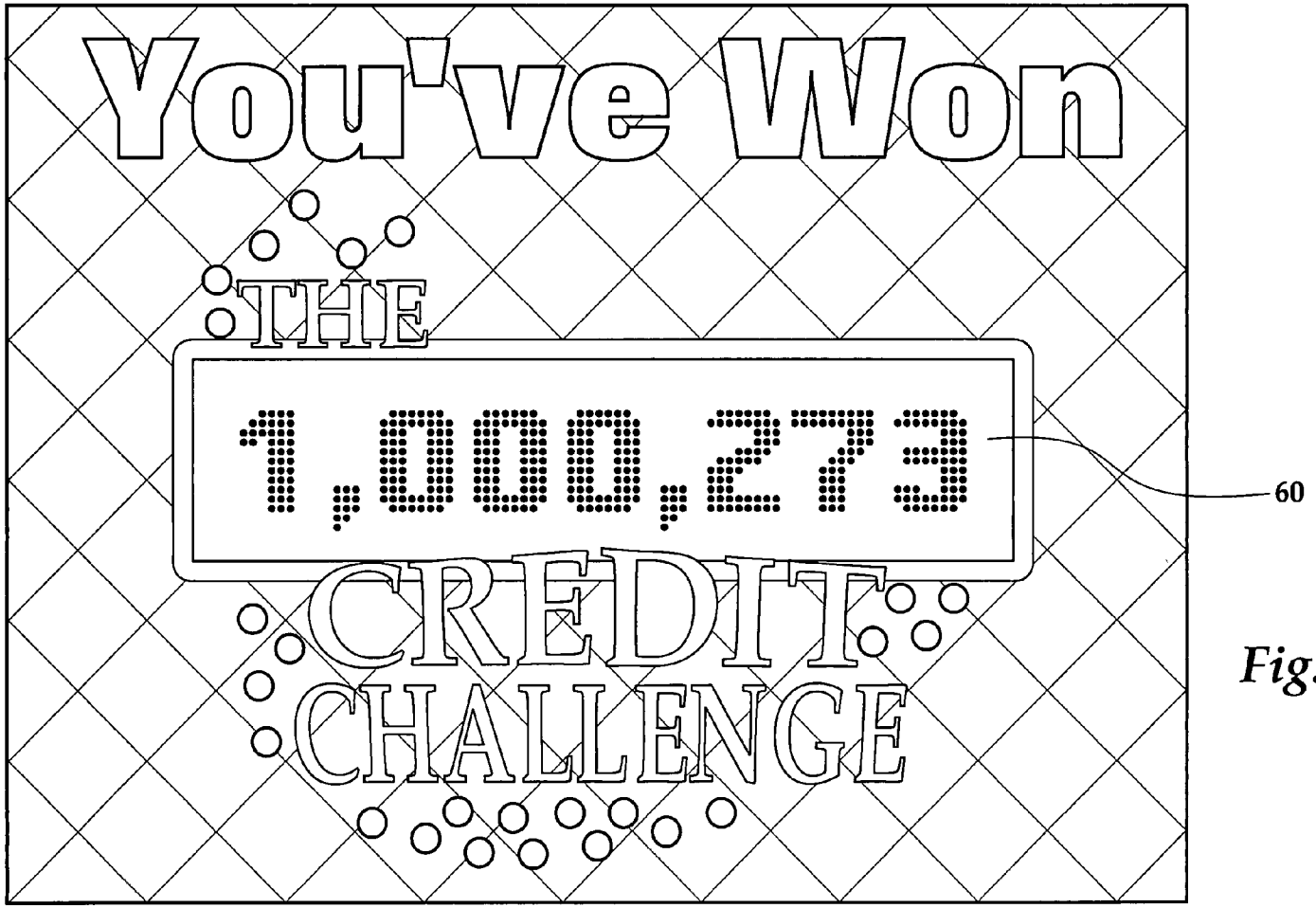

If the player successfully completes all seven challenges, the player is awarded the progressive jackpot 60. FIG. 11 is a display image associated with the award of this top prize upon successful completion of all challenges. As noted above, failure to satisfy the objective of any given challenge terminates the Million Credit Challenge and returns the player to the underlying wagering game (e.g. video slots). Whether the player wins the progressive jackpot 60 or not, the player is awarded any credits thus far accumulated through play of the challenges prior to termination of the Million Credit Challenge.

Instead of a single progressive jackpot 60, the Million Credit Challenge may include seven progressive jackpots associated with successful completion of the respective seven challenges. The seven progressive jackpots would generally be ranked from lowest to highest with the lowest progressive jackpot having the lowest reset value and the highest progressive jackpot having the highest reset value, e.g. one million credits. Successful completion of the first challenge would result in an award of the first progressive jackpot; successful completion of the second challenge would result in an award of the second progressive jackpot; successful completion of the third challenge would result in an award of the third progressive jackpot; and so on. In one embodiment, the player would only be awarded the progressive jackpot associated with the last successfully completed challenge, and would not also win the progressive jackpots associated with successfully completed challenges prior to the last successfully completed challenge. In another embodiment, the player would be awarded the progressive jackpots associated with all successfully completed challenges such that the player would accumulate progressive jackpot awards as the challenges are successfully completed. In any of these embodiments, the player may also win non-progressive awards such as the credit amounts associated with winning outcomes that occur during each challenge.

The player's wager just prior to the triggering of the Million Credit Challenge preferably affects one or more of (i) the probability of triggering the Million Credit Challenge, (ii) an award multiplier assigned to the player upon entering the Million Credit Challenge, (iii) the sequence in which the challenges are played, and (iv) the probability of successfully completing one or more of the challenges. With respect to (i), the higher the player's wager, the greater the probability of triggering the Million Credit Challenge. With respect to (ii), the higher the player's wager at the moment the Million Credit Challenge is triggered, or during a predetermined time period prior to the triggering of the Million Credit Challenge, the greater the award multiplier. The multiplier is applied to any awards, including progressive jackpots, won during the Million Credit Challenge. With respect to (iii), the challenges may be associated with different fixed levels of difficulty. The higher the player's wager, the challenges may be ordered, or more likely to be ordered, such that one or more easier challenges are faced by the player prior to one or more relatively difficult challenges.

With respect to (iv), the higher the player's wager, the easier it would be to complete a certain one or more of the challenges. The player's wager may affect the level of difficulty of all of the challenges, more than one but less than all of the challenges, or only one of the challenges. If the player's wager affects the level of difficulty of less than all of the challenges, the affected challenges may be randomly chosen or predefined. To vary the level of difficulty of a challenge, the objective or threshold for successful completion may be varied. For example, if the player must accumulate a threshold number of credits for successful completion of a challenge, this threshold number may be increased in order to increase the level of difficulty or lessened in order to decrease the level of difficulty. In one embodiment, if the player wagers a maximum amount when the Million Credit Challenge occurs, the player is guaranteed to successfully complete the first challenge he or she faces.

Each of these embodiments and obvious variations thereof is contemplated as falling within the spirit and scope of the claimed invention, which is set forth in the following claims.

What is claimed is:

1. A gaming system for conducting a wagering game, comprising:

a value input device for receiving a wager from a player;

a display; and a controller coupled to the display and operable to cause the display to present a challenge feature in response to a triggering event, the challenge feature including an arrangement of player-selectable challenges of different types and having different objectives for successful completion, the challenge feature including an outcome that awards a progressive jackpot after a predetermined minimum number of challenges in the arrangement of challenges have been successfully met, the controller being configured to return the player from a currently played challenge to the arrangement of challenges upon successful completion of the currently played challenge and to advance the player to a player-selected one of the available displayed player-selectable challenges, the controller being further configured to repeat the acts of returning and advancing until the objective of the currently played challenge is not met.

2. The gaming system of claim 1, wherein the triggering event is independent of an outcome of a basic game played by the player at a gaming terminal.

3. The gaming system of claim 2, wherein the wager influences an award multiplier assigned to the player upon entering the challenge feature, the award multiplier multiplying awards won during the challenge feature.

4. The gaming system of claim 2, wherein the wager influences a probability of meeting the objectives of one or more of the player-selectable challenges.

5. The gaming system of claim 2, wherein the wager influences a sequence in which the challenges are played.

6. The gaming system of claim 1, wherein at least one of the objectives includes finding a certain symbol, finding a certain number of symbols, exceeding at least a minimum number of points or credits, or not exceeding a maximum number of points or credits.

7. The gaming system of claim 1, wherein the progressive jackpot is a multi-level progressive jackpot.

8. The gaming system of claim 1, wherein the outcome for awarding the progressive jackpot includes meeting the objective of each challenge in the arrangement of player-selectable challenges.

9. The gaming system of claim 1, wherein each of the challenges in the arrangement is associated with a respective progressive jackpot, and wherein the outcome for awarding the progressive jackpot includes meeting the objective of at least one challenge in the arrangement, the progressive jackpot being the progressive jackpot associated with the at least one challenge.

10. The gaming system of claim 1, wherein the plurality of challenges presented to the player on the display comprises both interactive challenges and non-interactive challenges.

11. The gaming system of claim 10, wherein at least one of the interactive challenges comprises a picking game.

12. The gaming system of claim 10, wherein at least one of the non-interactive challenges comprises a plurality of spins of one or more symbol-bearing reels.

13. The gaming system of claim 10, wherein the interactive challenges comprise at least one challenge having as its objective finding a certain symbol prior to the selected challenge's termination, finding a certain number of symbols prior to the challenge's termination, accumulating at least a certain number of credits prior to the challenge's termination, or accumulating less than a certain number of credits prior to the challenge's termination.

14. The gaming system of claim 10, wherein the non-interactive challenges comprise at least one challenge including free spins of reels bearing wagering game related indicia, wherein the at least one challenge has as its objective accumulating at least a predetermined minimum number of credits during the free spins, accumulating less than a predetermined number of maximum number of credits during the free spins, accumulating at least a predetermined number of a predetermined symbol during the free spins, or accumulating on each reel at least a predetermined number of a predetermined symbol during the free spins.

15. The gaming system of claim 10, wherein the interactive challenges comprise at least one challenge having as its objective finding a certain symbol prior to the selected challenge's termination, finding a certain number of symbols prior to the challenge's termination, accumulating at least a certain number of credits prior to the challenge's termination, or accumulating less than a certain number of credits prior to the challenge's termination, and wherein the non-interactive challenges comprise at least one challenge including free spins of reels bearing wagering game related indicia, wherein the at least one challenge has as its objective accumulating at least a predetermined minimum number of credits during the free spins, accumulating less than a predetermined number of maximum number of credits during the free spins, accumulating at least a predetermined number of a predetermined symbol during the free spins, or accumulating on each reel at least a predetermined number of a predetermined symbol during the free spins.

16. The gaming system of claim 10, wherein the interactive challenges comprise a plurality of interactive challenges, each of the interactive challenges having as its objective a different one of finding a certain symbol prior to the selected challenge's termination, finding a certain number of symbols prior to the challenge's termination, accumulating at least a certain number of credits prior to the challenge's termination, or accumulating less than a certain number of credits prior to the challenge's termination, and wherein the non-interactive challenges comprise a plurality of non-interactive challenges involving free spins of reels bearing wagering game related indicia, each of the non-interactive challenges having as its objective a different one of accumulating at least a predetermined minimum number of credits during the free spins, accumulating less than a predetermined number of maximum number of credits during the free spins, accumulating at least a predetermined number of a predetermined symbol during the free spins, or accumulating on each reel at least a predetermined number of a predetermined symbol during the free spins.

17. A method of conducting a wagering game on a gaming system apparatus, the method comprising:

receiving a wager from a player in a wager input device associated with the gaming system apparatus;

displaying on a display associated with the gaming system a challenge feature in response to a triggering event, the displayed challenge feature including a plurality of player-selectable challenges of different types and having different objectives for successful completion, the challenge feature including an outcome that awards a progressive jackpot after a predetermined minimum number of challenges in the plurality of challenges have been successfully met;

prompting the player to select a subsequent challenge from the plurality of challenges each time a currently-played challenge is successfully completed; and successively advancing the player from challenge to challenge in the plurality of challenges in the challenge feature displayed on the display until the objective of the currently played challenge is not met or until the player successfully achieves the outcome for awarding the progressive jackpot.

18. The method of claim 17, further including conducting a basic game on the gaming system apparatus, and wherein the triggering event is independent of an outcome of the basic game.

19. The method of claim 17, wherein at least one of the objectives includes finding a certain symbol amongst symbols displayed on the display, finding a certain number of symbols amongst symbols displayed on the display, exceeding at least a minimum number of points or credits, or not exceeding a maximum number of points or credits.

20. The method of claim 17, wherein the outcome awards a respective one of a plurality of progressive jackpots each time the player successfully completes one of the player-selectable challenges.

21. The method of claim 17, wherein the outcome awards only the jackpot in a plurality of progressive jackpots associated with the last successfully completed challenge, the plurality of progressive jackpots each having a different value and corresponding to successful completion of a different one of the plurality of player-selectable challenges.

22. The method of claim 17, wherein the outcome for awarding the progressive jackpot includes meeting the objective of each challenge in the plurality of player-selectable challenges.

23. The method of claim 17, wherein each of the challenges in the plurality is associated with a respective progressive jackpot, and wherein the outcome for awarding the progressive jackpot includes meeting the objective of at least one challenge in the plurality of player-selectable challenges, the progressive jackpot being the progressive jackpot associated with the at least one challenge.

24. The method of claim 17, wherein the wager affects one or more of the following: (i) a probability of triggering the challenge feature; (ii) an award multiplier assigned to the player upon entering the challenge feature, the award multiplier multiplying awards won during the challenge feature; (iii) a sequence in which the challenges are played;

and (iv) a probability of meeting the objectives of one or more of the challenges.

25. A computer readable storage medium encoded with instructions for directing a gaming system to perform the method of claim 17.

26. A gaming system comprising:

a plurality of gaming terminals coupled to a progressive jackpot, each gaming terminal including a display and a value input device for receiving a wager; and a controller coupled to a presentation apparatus and operable to cause the presentation apparatus to display a challenge feature in response to a triggering event, the challenge feature including a plurality of player-selectable challenges of different types and having different objectives for successful completion, the plurality of player-selectable challenges including an outcome that awards the progressive jackpot, the controller being configured to, upon successful completion of an objective of a selected challenge and selection by a player of another challenge, advance the player from the selected challenge in the plurality of challenges to another selected challenge in the plurality of challenges and to continue the advancing of play from challenge to challenge in the plurality of challenges until an objective of a challenge is not met.

27. The gaming system of claim 26, wherein the presentation apparatus includes at least one of the following: (i) the display of the gaming terminal on which the challenge feature is triggered and (ii) a community display associated with the plurality of gaming terminals.

28. A method of conducting a wagering game on a gaming system having a wager input device, a display, and a controller operatively connected to the wager input device and the display, the method comprising:

receiving a wager from a player via the wager input device;

displaying via the display a challenge feature in response to a triggering event, the displayed challenge feature including a plurality of player-selectable icons each representing a different challenge having different objectives for successful completion thereof;

via the controller, thereafter:

(A) prompting the player to select from the plurality of player-selectable icons displayed via the display;

(B) determining if the player successfully completes the different challenge associated with the selected icon; and (C) returning to step (A) if the player successfully completes the different challenge associated with the selected icon; or (D) terminating the challenge feature if the player does not successfully complete the different challenge associated with the selected icon;

awarding a progressive jackpot after a predetermined minimum number of challenges have been successfully completed.

* * * * *